US007576659B2

(12) United States Patent
Lax

(10) Patent No.: US 7,576,659 B2
(45) Date of Patent: Aug. 18, 2009

(54) SMOKE DETECTION AND LASER ESCAPE INDICATION SYSTEM UTILIZING BASE AND SATELLITE

(75) Inventor: Samuel Lax, Mission Hills, CA (US)

(73) Assignee: L.I.F.E. Support Technologies, LLC, Mission Hills, CA (US)

( * ) Notice: Subject to any disclaimer, the term of this patent is extended or adjusted under 35 U.S.C. 154(b) by 182 days.

(21) Appl. No.: 11/422,666

(22) Filed: Jun. 7, 2006

(65) Prior Publication Data

US 2007/0285265 A1 Dec. 13, 2007

(51) Int. Cl.
*G08B 17/10* (2006.01)

(52) U.S. Cl. ..... 340/628; 340/632; 340/500; 340/532

(58) Field of Classification Search ..... 340/627–630, 340/632, 633, 500, 528, 532
See application file for complete search history.

(56) References Cited

U.S. PATENT DOCUMENTS

| | | | | |
|---|---|---|---|---|
| 4,148,023 | A | 4/1979 | Elkin | |
| 4,160,246 | A * | 7/1979 | Martin et al. | 340/630 |
| 4,166,960 | A | 9/1979 | Meili | |
| 4,199,754 | A | 4/1980 | Johnson et al. | |
| 4,570,155 | A | 2/1986 | Skarman et al. | |
| 4,649,376 | A | 3/1987 | Frank | |
| 4,763,115 | A | 8/1988 | Cota | |
| 4,801,928 | A | 1/1989 | Minter | |
| 4,808,977 | A | 2/1989 | Hedrick | |
| 4,827,244 | A | 5/1989 | Bellavia et al. | |
| 5,140,301 | A | 8/1992 | Watanabe | |
| 5,572,183 | A | 11/1996 | Sweeney | |
| 5,587,705 | A * | 12/1996 | Morris | 340/628 |
| 5,612,665 | A | 3/1997 | Gerhardsen | |
| 5,786,767 | A * | 7/1998 | Severino | 340/628 |
| 5,898,369 | A * | 4/1999 | Godwin | 340/539.26 |
| 6,133,839 | A * | 10/2000 | Ellul et al. | 340/584 |
| 6,150,943 | A | 11/2000 | Lehman et al. | |
| 6,181,251 | B1 * | 1/2001 | Kelly | 340/628 |
| 6,249,221 | B1 * | 6/2001 | Reed | 340/539.14 |
| 6,323,780 | B1 * | 11/2001 | Morris | 340/692 |
| 6,420,973 | B2 * | 7/2002 | Acevedo | 340/628 |
| 6,426,703 | B1 * | 7/2002 | Johnston et al. | 340/628 |
| 6,778,082 | B2 * | 8/2004 | Goodwin | 340/539.1 |
| 6,819,252 | B2 * | 11/2004 | Johnston et al. | 340/630 |
| 7,199,724 | B2 * | 4/2007 | Danvir et al. | 340/691.1 |
| 2005/0184864 | A1 * | 8/2005 | Picard et al. | 340/506 |
| 2007/0241876 | A1 * | 10/2007 | Johnston et al. | 340/506 |

* cited by examiner

*Primary Examiner*—Eric M Blount
(74) *Attorney, Agent, or Firm*—Kelly Lowry & Kelley LLP

(57) ABSTRACT

A smoke detector system having a base unit and multiple satellite units is provided. The base unit detects various hazards, i.e., smoke or carbon monoxide, and broadcasts a radio frequency signal to activate warning devices on the various satellite units. The satellite units include a radio frequency receiver to receive the signal broadcasted by the base unit. The warning devices include a laser cannon, a speaker, a strobe light, and a wireless camera separately or in combination with other warning devices. Alternatively, each base unit may include one or more of the warning devices and a radio frequency receiver, and each satellite unit may include the detection devices and a radio frequency transmitter. In this way, each device in the system may activate warning devices in each other device in the system when a hazard is detected.

20 Claims, 4 Drawing Sheets

SMOKE DETECTION AND LASER ESCAPE INDICATION SYSTEM UTILIZING BASE AND SATELLITE

BACKGROUND OF THE INVENTION

This invention relates generally to smoke detector systems having a base unit and multiple satellite units. More particularly, this invention relates to a smoke detector system wherein the base unit has a detection means and a radio frequency transmitter; and the multiple satellite units have a radio frequency receiver and one of a laser cannon, a speaker, a strobe light, and a wireless camera.

Smoke detectors are well known in the prior art; and two examples of modern smoke alarms are provided in U.S. Pat. No. 4,827,244 to Bellavia, and U.S. Pat. No. 4,166,960 to Meili. Typically, smoke detectors simply provide an audible alarm to alert people nearby that there is a fire.

Improved smoke detectors not only sound an alarm when smoke is detected, they also activate powerful lights or flashing strobes to help direct people to an exit. Frank, U.S. Pat. No. 4,649,376, for example, discloses the use of powerful flashing Xenon lamps to pierce smoke and direct people to the exit. Other examples of this technology are described in U.S. Pat. No. 4,148,023 to Elkin, U.S. Pat. No. 4,570,155 to Skarman, and U.S. Pat. No. 4,763,115 to Cota. While these devices can be useful in some circumstances, the flashing incandescent lights can tend to daze and confuse rather than direct, especially in a smoky room where it may not be apparent where the flashes of light are originating. Furthermore, intense flashing lights destroy night vision, often causing more harm than good to confused people trying to escape a dark building.

Cota, U.S. Pat. No. 4,763,115, further discloses the use of a redundant circuit that is activated by a central audio alarm to trigger the smoke alarm and slashing circuits.

Sweeney, U.S. Pat. No. 5,572,183, discloses a device that sweeps a laser beam across a plurality of mirrors. Each mirror directs the laser beam into the floor at a different location, thereby "walking" that apparent laser beam towards an exit. Watanabe, U.S. Pat. No. 5,140,301, discloses, a centrally controlled network that generates a laser which is guided and oscillated by a controlling mirror.

Kelly, U.S. Pat. No. 6,181,251, discloses a smoke detector that includes a pulsed laser in a single housing with the detection means. The pulsed laser is mounted on a laser pointing means which allows for pointing the laser in multiple directions.

None of the prior art devices teach a two-device system where one device contains the detecting means and a radio transmitter and the second and subsequent devices contain a radio receiver and an alert means, i.e., a laser cannon, a speaker, a strobe light, or a wireless camera.

Accordingly, a two-device system is needed which allows for greater variation and configuration of the system and breadth of coverage by the system. In single device systems that are not networked, detectors in different locations in the structure may not become activated at the same time thereby presenting a danger to those people in locations where the stand alone device has not yet been activated. In contrast, multiple device systems employing radio frequency transmitters and receivers may be configured to activate all alert means simultaneously when any single device detects a hazard. The present invention fulfills these needs and provides further related advantages.

SUMMARY OF THE INVENTION

The present invention relates to a system for detecting smoke and/or carbon monoxide comprising a base unit having a smoke detector and a carbon monoxide detector and a satellite unit having one of a laser cannon, a speaker, a strobe light, and a wireless camera. The base unit includes a radio frequency transmitter and the satellite unit includes a radio frequency receiver. In the event that the base unit detects smoke or carbon monoxide, the radio frequency transmitter sends a signal to the radio frequency receiver to activate the alert means, i.e., laser cannon, speaker, strobe light, wireless camera, in the satellite unit.

The laser cannon in the satellite unit is configured to illuminate an exit from the room when the satellite unit is activated. In addition to the laser cannon, the satellite unit also includes a speaker to issue an audible alarm when the satellite unit is activated. The audible alarm may comprise a standard whoop or beep alarm or a prerecorded verbal message.

The base unit further includes a power indicator LED, a smoke indicator LED, and a carbon monoxide indicator LED. The smoke detector may comprise an ionization sensor and/or a photoelectric sensor.

The system may comprise two or more satellite units, a first satellite unit having a laser cannon and a second satellite unit having a strobe light. The first satellite unit may also include a speaker. The system may also comprise multiple satellite units, each having laser cannons, distributed throughout a building having multiple rooms. The distribution is such that each room has at least one exit illuminated by a laser cannon when the satellite units are activated.

In a further embodiment, the base unit may also include a radio frequency receiver and one of a laser cannon, a speaker, a strobe light, and a wireless camera. Further, the satellite unit may include a smoke detector, a carbon monoxide detector, and a radio frequency transmitter. In this way each device in the system is capable of detecting smoke and/or carbon monoxide and activating all other devices in the system by means of the radio frequency transmitters and receivers.

Other features and advantages of the present invention will become apparent from the following more detailed description, taken in conjunction with the accompanying drawings, which illustrate, by way of example, the principles of the invention.

BRIEF DESCRIPTION OF THE DRAWINGS

The accompanying drawings illustrate the present invention. In such drawings.

DETAILED DESCRIPTION OF THE PREFERRED EMBODIMENTS

Figure 1:
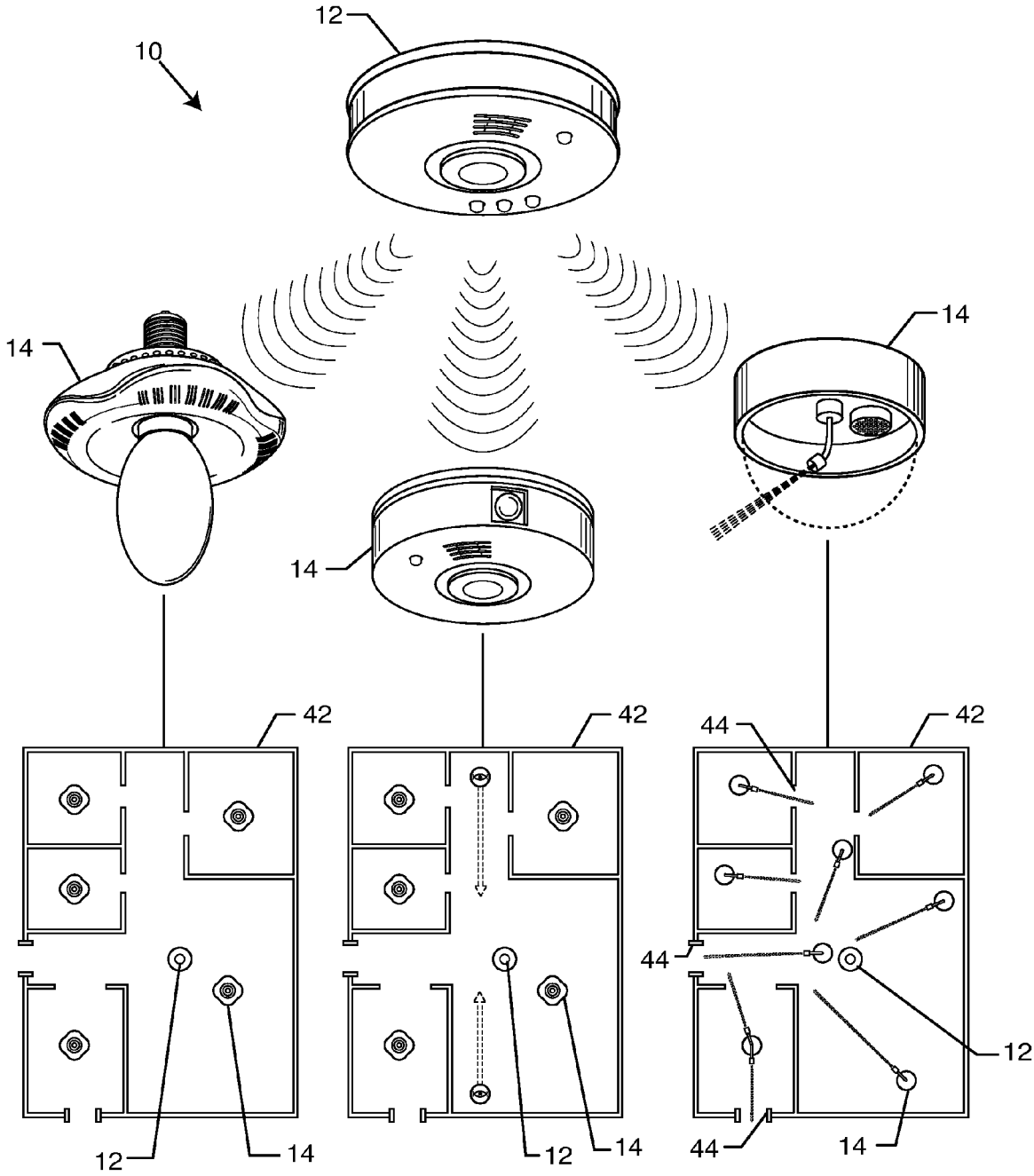
FIG. 1 is a schematic diagram of a system of a base unit and satellite units of the present invention.
Figure 2:
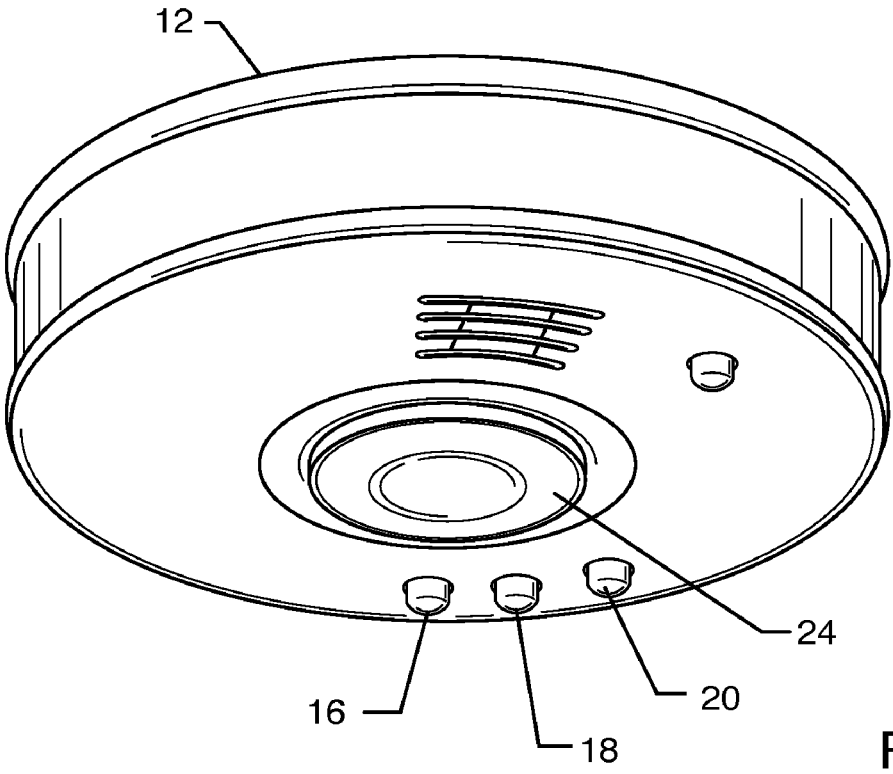
FIG. 2 is a perspective view of a base unit of the present invention.
Figure 3:
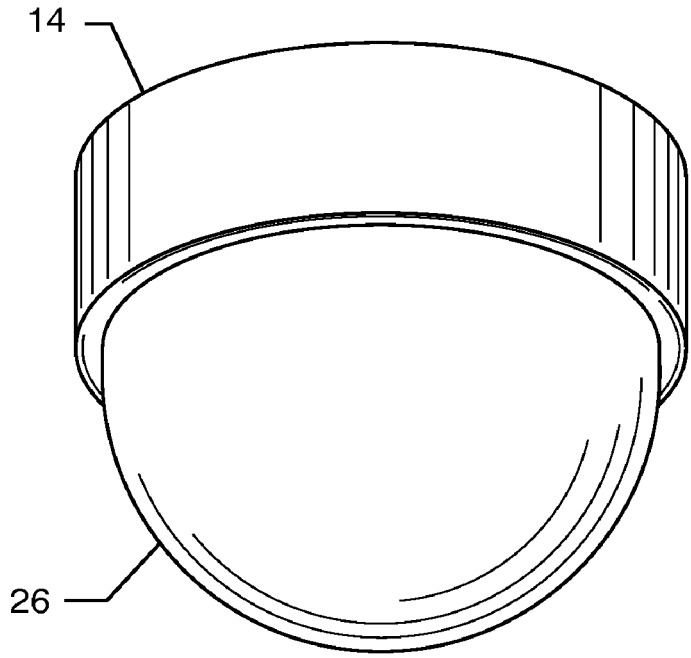
FIG. 3 is a perspective view of one embodiment of a satellite unit of the present invention.
Figure 4:
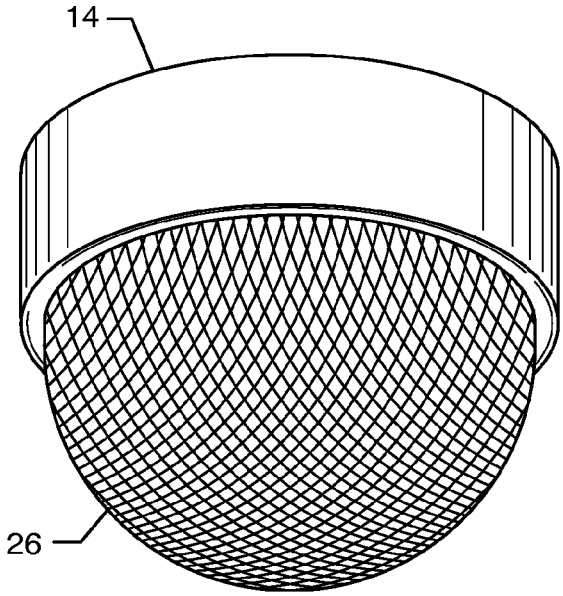
FIG. 4 is a perspective view of an alternate embodiment of a satellite unit of the present invention.
Figure 5:
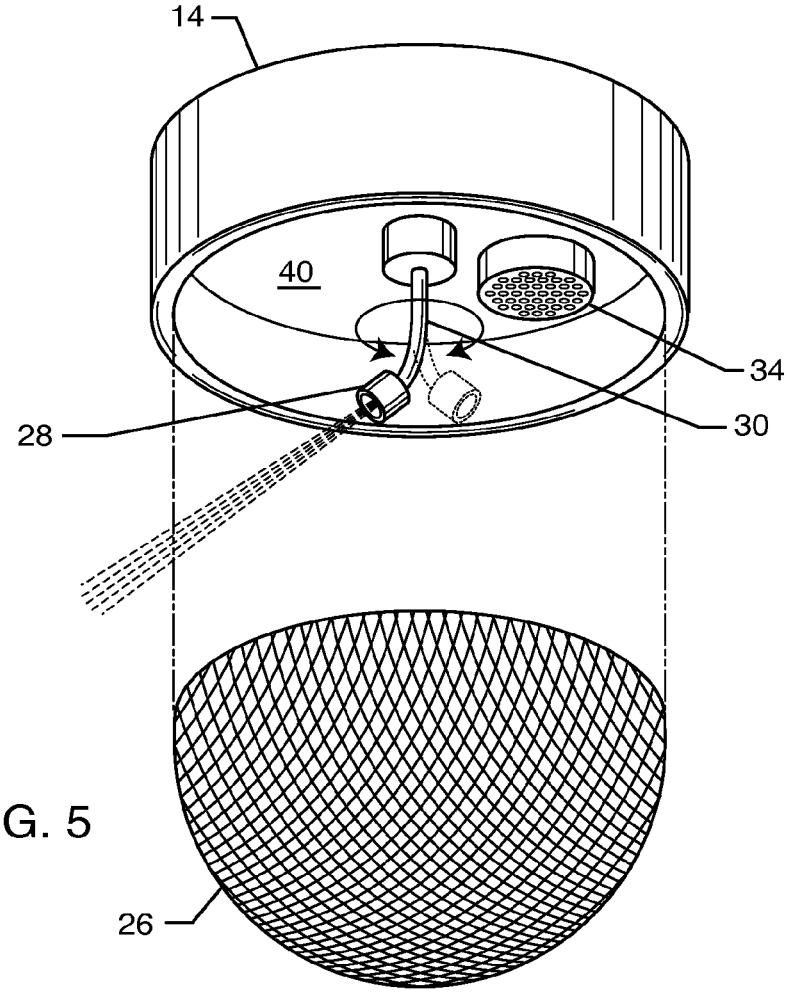
FIG. 5 is an exploded perspective view of an alternate embodiment of a satellite unit of the present invention.
Figure 6:
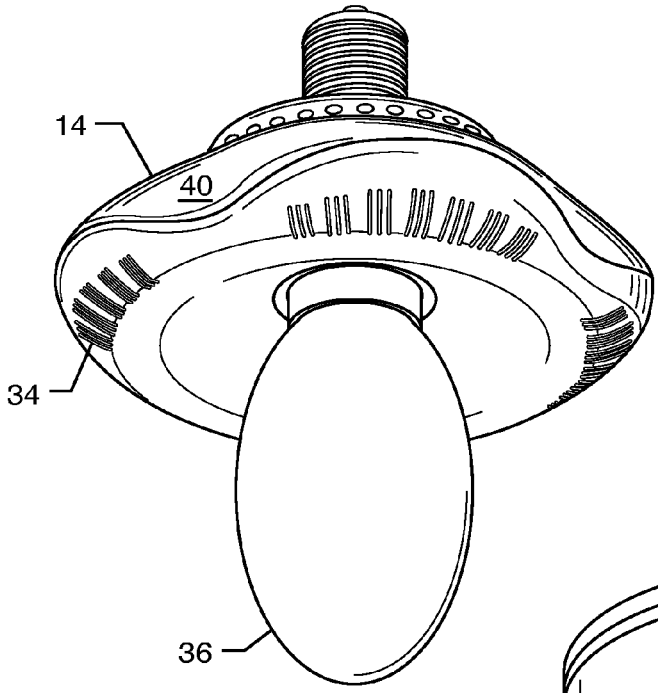
FIG. 6 is a perspective view of a satellite unit of the present invention including a strobe light.
Figure 7:
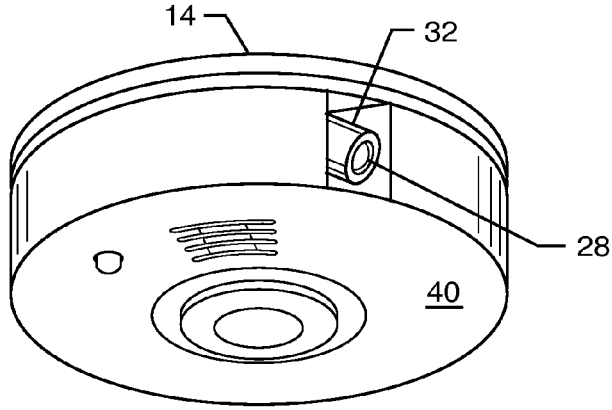
FIG. 7 is a perspective view of a satellite unit of the present invention including a laser cannon.
Figure 8:
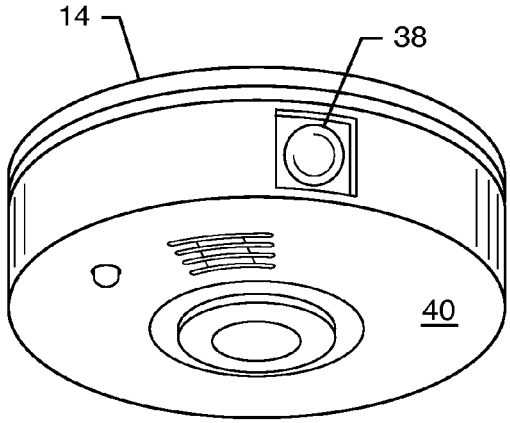
FIG. 8 is a perspective view of a satellite unit of the present invention including a video camera.

The present invention is directed to a system for detecting smoke and/or carbon monoxide. As shown in FIG. 1, a preferred embodiment of the system 10 comprises a base unit 12 and one or more satellite units 14. FIG. 2 depicts the base unit 12 having an ionization smoke detector circuit 17 with LED 16, a photoelectric smoke detector circuit 19 with LED 18, and a carbon monoxide detector circuit 21 with LED 20. The base unit 12 also includes a radio frequency transmitter 22 for sending a signal when one of the detectors 17, 19, 21 detects a hazard. The base unit 12 may also include a test button 24 for testing the system 10.

The satellite units 14 come in multiple variations as depicted in FIGS. 3-8. One variation includes a translucent dome 26 and a laser cannon 28. The laser cannon 28 may be mounted on a flexible rotatable arm 30 (FIG. 5) or an adjustable hinged mounting 32 (FIG. 7) on a rotatable satellite unit 14. Satellite unit 14 may also include a speaker 34 alone or in conjunction with the laser cannon 28. An alternate version of the satellite unit 14 may include a strobe light 36 alone or in conjunction with a speaker 34. A still further variation on the satellite unit 14 may include a wireless camera 38 that is capable of transmitting a signal to a computer or other Internet ready device. Each of the satellite units 14 include a radio frequency receiver 40 for receiving a signal generated by the base unit 12 thereby activating the satellite units 14 in the system 10.

The system 10 may be installed in a structure such that one or more base units 12 are distributed throughout the structure to provide adequate hazard detection coverage to ensure the safety of those inside the structure. As described above, each of the base units 12 includes a radio frequency transmitter 22 and multiple detection means 17, 19, 21. When one of the detection means 17, 19, 21 detects the presence of a hazard, i.e., smoke or carbon monoxide, the radio frequency transmitter 22 broadcasts a signal to activate the multiple satellite units 14.

The multiple satellite units 14 may be distributed throughout a structure 42 as shown in FIG. 1. Satellite units 14 that include a laser cannon 28 are distributed throughout the structure such that the laser cannon 28 illuminates at least one available exit 44 from a room within the structure 42 when the satellite unit 14 is activated. Similarly, satellite units 14 that include a strobe light 36 may also be distributed throughout the structure 42 such that the strobe light 36 illuminates a pathway out of the room or structure. Satellite units 14 may also include a speaker 34 either in conjunction with the laser cannon 28 or strobe light 36, or as a stand alone alert means. When a satellite unit 14 having only a speaker 34 is used, the satellite units 14 are distributed throughout the structure 42 to ensure that the audible warning issued from the speaker can be heard in every room in the structure. Other satellite units 14 having a wireless camera 38 may be distributed throughout the structure 42 such that the camera records and transmits an image of one or more pathways out of the structure 42 such that the image may be viewed remotely for the safety of persons within the structure.

Each of the above described satellite units 14 include a radio frequency receiver 40 as described above. This radio frequency receiver 40 is configured to receive the signal broadcast by the radio frequency transmitter 22 in the base unit 12. When the radio frequency receiver 40 receives the broadcast signal from the radio frequency transmitter 22, the satellite units 14 activate the various alert means included thereon.

In practice this method of operation results in a greater level of safety for persons in the structure 42 in the event of a hazard. The use of the radio frequency transmitter 22 and radio frequency receiver 40 permits the simultaneous activation of every satellite unit 14 in the structure 42 to ensure that all persons are alerted to a hazard at the same time. In this way, persons on the opposite side of a structure 42 from a detected hazard may receive warning before the hazard reaches their area of the structure.

In an alternate embodiment, in addition to the base unit 12 having a radio frequency transmitter 22 and detection means 17, 19, 21, each satellite unit 14 may also include a radio frequency transmitter 22 and detection means 17, 19, 21. Further, each base unit 12 may include a radio frequency receiver 40 and one of the various alert means 28, 34, 36, 38. In this way, the inventive system 10 may accomplish the above stated purposes with a minimum of base units 12 and satellite units 14 installed in the structure. Each base unit 12 and satellite unit 14 is capable of detecting a hazard and broadcasting a radio frequency signal to activate the various alert means 28, 30, 34, 36, 38. Similarly, each base unit 12 is equipped with its own alert means 28, 30, 34, 36, 38 which is activated when the radio frequency receiver 40 contained therein receives a signal broadcast by a radio frequency transmitter 22 located in either a base unit 12 or satellite unit 14. This embodiment allows for a system 10 designed to achieve the purposes of this invention with the least number of units 12, 14 installed in the structure.

The components of the system 10 have increased moisture and coercion resistance through the application of a spray-on silicon. Spray-on silicon protects the circuits and other electronic components of the base units 12 and satellite units 14 from corrosion or degradation due to moisture in the air. This improved corrosion resistance increases the effective life span of the units 12, 14.

Although several embodiments of the present invention have been described in detail for purposes of illustration, various modifications of each may be made without departing from the spirit and scope of the invention. Accordingly, the invention is not to be limited, except as by the appended claims.

What is claimed is:

1. A system for detecting smoke and/or carbon monoxide comprising:

a base unit comprising a smoke detector, a carbon monoxide detector, a strobe light, a radio frequency transmitter and a radio frequency receiver; and a satellite unit having a radio frequency transmitter in communication with the radio frequency receiver of the base unit, a radio frequency receiver in communication with the radio frequency transmitter of the base unit, a camera in wireless communication with a remote computer and a laser cannon;

wherein the radio frequency transmitter of the base unit sends a signal to the radio frequency receiver of the satellite unit to activate the satellite unit in the event smoke or carbon monoxide is detected.

2. The system of claim 1, wherein the laser cannon is configured to illuminate an exit when the satellite unit is activated.

3. The system of claim 2, wherein the satellite unit also has a speaker to issue an audible alarm when the satellite unit is activated.

4. The system of claim 3, wherein the audible alarm comprises a prerecorded message.

5. The system of claim 1, wherein the base unit further includes a power indicator LED, a smoke indicator LED, and a carbon monoxide indicator LED.

6. The system of claim 1, wherein the smoke detector comprises an ionization sensor and/or a photoelectric sensor.

7. The system of claim 1, further comprising two satellite units, a first satellite unit having a laser cannon and a second satellite unit having a strobe light.

8. The system of claim 7, wherein the first satellite unit also has a speaker.

9. The system of claim 1, further comprising multiple satellite units having laser cannons distributed throughout a structure having multiple rooms, each room having at least one exit, wherein the satellite units are distributed such that the laser cannons illuminate at least one of the exits from each room when the satellite units are activated.

10. The system of claim 1, wherein the base unit includes one of a laser cannon, a speaker, and a wireless camera.

11. The system of claim 1, wherein the satellite unit includes a smoke detector and a carbon monoxide detector.

12. A system for detecting smoke and/or carbon monoxide comprising:

a base unit having a smoke detector, a carbon monoxide detector, a strobe light, a radio frequency transmitter and a radio frequency receiver; and two satellite units each having a radio frequency transmitter in communication with the radio frequency receiver of the base unit, a radio frequency receiver in communication with the radio frequency transmitter of the base unit and a wireless camera in communication with a remote computer, such that a first satellite unit has a laser cannon and a second satellite unit has a strobe light;

wherein the radio frequency transmitter of the base unit sends a signal to each radio frequency receiver of the satellite units to activate the satellite units in the event smoke or carbon monoxide is detected; and wherein the smoke detector comprises an ionization sensor and/or a photoelectric sensor.

13. The system of claim 12, wherein the first satellite unit also has a speaker to issue an audible alarm when the satellite unit is activated.

14. The system of claim 13, wherein the audible alarm comprises a prerecorded message.

15. The system of claim 12, wherein the base unit further includes a power indicator LED, a smoke indicator LED, and a carbon monoxide indicator LED.

16. The system of claim 12, further comprising multiple satellite units having laser cannons distributed throughout a structure having multiple rooms, each room having at least one exit, wherein the satellite units are distributed such that the laser cannons illuminate at least one of the exits from each room when the satellite units are activated.

17. The system of claim 12, wherein the base unit includes one of a laser cannon, a speaker, and a wireless camera

18. The system of claim 12, wherein the satellite unit includes a smoke detector and a carbon monoxide detector.

19. A system for detecting smoke and/or carbon monoxide comprising:

a base unit having a smoke detector, a carbon monoxide detector, a strobe light, a radio frequency transmitter and a radio frequency receiver; and multiple satellite units each having a radio frequency transmitter in communication with the radio frequency receiver of the base unit, a radio frequency receiver in communication with the radio frequency transmitter of the base unit and a wireless camera in communication with a remote computer, such that a first satellite unit has a laser cannon and a second satellite unit has a strobe light;

wherein the radio frequency transmitter of the base unit sends a signal to each radio frequency receiver of the satellite units to activate the satellite units in the event smoke or carbon monoxide is detected; and wherein the multiple satellite units having laser cannons are distributed throughout a structure having multiple rooms, each room having at least one exit, wherein the satellite units are distributed such that the laser cannons illuminate at least one of the exits from each room when the satellite units are activated.

20. The system of claim 19, wherein the base unit includes one of a laser cannon, a speaker, and a wireless camera, and each satellite unit includes a smoke detector and a carbon monoxide detector.

* * * * *